US005324611A

United States Patent [19]

Fuller et al.

[11] Patent Number: 5,324,611

[45] Date of Patent: * Jun. 28, 1994

[54] TONER COMPOSITIONS WITH HYDROGENATED COMPONENTS

[75] Inventors: Timothy J. Fuller, W. Henrietta; Ralph A. Mosher, Rochester, both of N.Y.

[73] Assignee: Xerox Corporation, Stamford, Conn.

[ * ] Notice: The portion of the term of this patent subsequent to Oct. 27, 2009 has been disclaimed.

[21] Appl. No.: 988,524

[22] Filed: Dec. 10, 1992

[51] Int. Cl.[5] ..... G03G 9/083; G03G 9/087

[52] U.S. Cl. ..... 430/106; 430/106.6; 430/109; 430/114; 430/138

[58] Field of Search ..... 430/106, 106.6, 109, 430/110, 114

[56] References Cited

U.S. PATENT DOCUMENTS

| | | | |
|---|---|---|---|
| 4,100,087 | 7/1978 | Takayama et al. . | |
| 4,529,680 | 7/1985 | Asanae et al. | 430/106.6 |
| 4,927,675 | 5/1990 | Adams et al. | 428/35.9 |
| 4,952,477 | 8/1990 | Fuller et al. | 430/109 |
| 4,990,424 | 2/1991 | Van Dusen et al. | 430/106.6 |
| 5,158,851 | 10/1992 | Fuller et al. | 430/109 X |

FOREIGN PATENT DOCUMENTS

| | | | |
|---|---|---|---|
| 11755 | 1/1986 | Japan | 430/109 |

*Primary Examiner*—Roland Martin
*Attorney, Agent, or Firm*—E. O. Palazzo

[57] ABSTRACT

A toner composition comprised of hydrogenated resin particles and pigment particles.

22 Claims, No Drawings

TONER COMPOSITIONS WITH HYDROGENATED COMPONENTS

BACKGROUND OF THE INVENTION

This invention is generally directed to toner compositions, and more specifically, the present invention relates to developers comprised of toner compositions comprised of low melt resin particles. In one embodiment, the present invention relates to a toner composition comprised of hydrogenated resin particles, colorants, such as known pigment particles, and optional additives, such as charge control components. In another embodiment of the present invention, the toner composition can be hydrogenated to, for example, improve its blocking and release characteristics. More specifically, in one embodiment of the present invention there are provided developer compositions formulated by, for example, admixing low melting, about 220° F. to about 300° F., toner compositions hydrogenated with, for example, hydrogen or diimide, and carrier components. In another embodiment of the present invention, there are provided toner compositions with hydrogenated toner resins containing polymers prepared by bulk, solution, free radical, anionic, suspension, dispersion, or emulsion techniques, such as random or block copolymers $(A\text{-}B)_n$ wherein n represents the number of repeating polymer segments and where A and B represent monomeric or oligomeric segments of, for example, styrene and butadiene, respectively, which components possess in embodiments of the present invention a desirable low fusion and low fusing energy; are easily jettable or processable into toner compositions; enable low temperature fusing; are optically clear; allow matte and gloss finishes; and with the toner resins illustrated herein there can in embodiments be fabricated brittle, rubbery, or other similar toner polymers with an optimized melt viscosity profile, and a lowering of the fusing temperature characteristics of the toner resin can be achieved. The hydrogenated toner polymers of the present invention can be processable by conventional toner means, that is these materials are extrudable, melt mixable and jettable. The toner compositions in embodiments of the present invention possess lower fusing temperatures, and therefore, lower fusing energies are required for fixing, thus enabling less power consumption during fusing, and permitting extended lifetimes for the fuser systems selected. Moreover, high gloss images may be obtained at lower fuser set temperatures. The toners of the present invention can be fused at temperatures (fuser roll set temperature) of between 220° and 320° F. in embodiments of the present invention as compared to a number of currently commercially available toners which fuse at temperatures of from about 300° to about 370° F. With further respect to the present invention, the ultra low melt resins have, for example, in embodiments thereof a glass transition temperature of from about 24° to about 80° C. and in embodiments employing cryogenic jetting conditions, glass transition temperatures of from about 0° or less to about 24° C. Known nonblocking characteristics, that is noncaking or retaining substantially all the properties of a free flowing powder at temperatures of, for example, about 120° F. or less are obtained with the toner compositions of the present invention in embodiments thereof. Further, the treated toner compositions of the present invention can be selected for single component development in that, for example, the toners resist smearing, and do not form toner aggregates under the pressure stresses usually selected for such development systems. Also, toner compositions containing the hydrogenated resins illustrated herein can include wax components such as on the surface to improve the release characteristics of the toner. In embodiments of the present invention, the wax component can be situated on the surface of the toner by hydrogenation of unsaturated olefin groups on the surface of the toner particles. These toners (referred to as H-Shell toners) possess shells of hydrogenated resin which encapsulate softer lower melting cores. In other embodiments, the hydrogenated toners allow better compatibilization of wax release agents into the toner composition by extrusion process rather than by rubber roll mill methods usually required to assure sufficient mixing of the wax with the toner composition. In other embodiments, the hydrogenated toner compositions are more resistant to decomposition by light, and are oxidatively and more chemically stable than their unsaturated counterparts. The chemical inertness of the toner compositions allows for improved tribostability to diverse charge control agents which would ordinarily react with unsaturated olefins in the toner compositions. For example, certain aluminum containing charge control agents react with olefinic butadiene double bonds. Thus, the hydrogenated toner compositions of the instant invention and their images offer the advantages of enhanced light, chemical and thermal stability by the elimination of reactive butadiene double bonds by hydrogenation. Other advantages include improved compatibility with wax release agents using extrusion processing, and improved inertness of the toner compositions to charge control agents, improved release characteristics and compatibility with VITON® and silicone fuser rolls. Other advantages include improved crease test results with fused images indicative of better fixing of xerographic images to paper. Moreover, because the glass transition temperatures of hydrogenated styrene-butadiene copolymers are often increased after hydrogenation (or by addition of hydrogen across olefinic double bonds) toner blocking behavior is improved. Hydrogenation allows increased amounts of butadiene in copolymers with styrene while maintaining a high Tg of the toner composition (near 55° C.). This translates into lower minimum fix temperatures due to increased soft nonstyrenic segments in the copolymers. The triboaging behavior is expected to be appreciably reduced due to the increased stability of the hydrogenated materials. Elimination of double bonds in the toners by hydrogenation is expected to improve fuser roll compatibility and improve release of molten toner images from the fuser roll to paper or transparency with improved image fastness or fix to paper. Increased copier reliability is anticipated.

Hydrogenation of toner resins or toner particles is accomplished by either heterogeneous (palladium on carbon) or the homogeneous Wilkinson or Crabtree catalysts. Diimide is also an effective reducing agent for the hydrogenation of olefinic bonds at atmospheric pressure in polar and apolar solvents. The advantage to diimide is that this reagent is expected to be an effective reagent for the hydrogenation of toner composition surfaces in alcohol or water and can be used to form hydrogenated polymer shells on toner surfaces. Improved blocking temperatures and release of toner images from fuser rolls result.

Toner and developer compositions are known, wherein there are selected as the toner resin styrene acrylates, styrene methacrylates, and certain styrene butadienes including those available as PLIOTONES®. Other resins have also been selected for incorporation into toner compositions inclusive of the polyesters as illustrated in U.S. Pat. No. 3,590,000. Moreover, it is known that single component magnetic toners can be formulated with styrene butadiene resins, particularly those resins available as PLIOLITE®. In addition, positively charged toner compositions containing various resins, inclusive of certain styrene butadienes and charge enhancing additives, are known. For example, there are described in U.S. Pat. No. 4,560,635, the disclosure of which is totally incorporated herein by reference, positively charged toner compositions with distearyl dimethyl ammonium methyl sulfate charge enhancing additives. The '635 patent also illustrates the utilization of suspension polymerized styrene butadienes for incorporation into toner compositions, reference for example working Example IX.

Numerous patents are in existence that illustrate toner compositions with various types of toner resins including, for example, U.S. Pat. Nos. 4,104,066, polycaprolactones; 3,547,822, polyesters; 4,049,447, polyesters; 4,007,293, polyvinyl pyridine-polyurethane; 3,967,962, polyhexamethylene sebaccate; 4,314,931, polymethyl methacrylates; Reissue 25,136, polystyrenes; and 4,469,770, styrene butadienes.

In U.S. Pat. No. 4,529,680, there are disclosed magnetic toners for pressure fixation containing methyl-1-pentene as the main component. More specifically, there are illustrated in this patent, reference column 2, beginning at line 66, magnetic toners with polymers containing essentially methyl-1-pentene as the main component, which polymer may be a homopolymer or copolymer with other alpha-olefin components. It is also indicated in column 3, beginning at around line 14, that the intrinsic viscosity of the polymer is of a specific range, and further that the melting point of the polymer is in a range of 150° to 240° C., and preferably 180° to 230° C. Other patents that may be of background interest include U.S. Pat. Nos. 3,720,617; 3,752,666; 3,788,994; 3,983,045; 4,051,077; 4,108,653; 4,258,116 and 4,558,108.

In addition, several patents illustrate toner resins including vinyl polymers, diolefins, and the like, reference for example U.S. Pat. No. 4,560,635. Moreover, there are illustrated in U.S. Pat. No. 4,469,770 toner and developer compositions wherein there are incorporated into the toner styrene butadiene resins prepared by emulsion polymerization processes.

Furthermore, a number of different carrier particles have been illustrated in the prior art, reference for example the U.S. Pat. No. 3,590,000 mentioned herein; and U.S. Pat. No. 4,233,387, the disclosures of which are totally incorporated herein by reference, wherein coated carrier components for developer mixtures, which are comprised of finely divided toner particles clinging to the surface of the carrier particles, are recited. In U.S. Pat. Nos. 4,937,166 and 4,935,326, the disclosures of which are totally incorporated herein by reference, there are illustrated, for example, carrier particles comprised of a core with a coating thereover comprised of a mixture of a first dry polymer component and a second dry polymer component not in close proximity to the first polymer in the triboelectric series. Other patents include U.S. Pat. No. 3,939,086, which teaches steel carrier beads with polyethylene coatings, see column 6; U.S. Pat. Nos. 3,533,835; 3,658,500; 3,798,167; 3,918,968; 3,922,382; 4,238,558; 4,310,611; 4,397,935 and 4,434,220.

Semicrystalline polyolefin resins or blends thereof are illustrated in U.S. Pat. No. 4,990,424 and U.S. Pat. No. 4,952,477, the disclosures of which are totally incorporated herein by reference. More specifically, in U.S. Pat. No. 4,952,477 there are disclosed toners with semicrystalline polyolefin polymer or polymers with a melting point of from about 50° to about 100° C., and preferably from about 60° to about 80° C. with the following formulas wherein x is a number of from about 250 to about 21,000; the number average molecular weight is from about 17,500 to about 1,500,000 as determined by GPC; and the $M_w/M_n$ dispersity ratio is from about 2 to about 15.

I. Polypentenes-$(C_5H_{10})_x$
II. Polytetradecenes-$(C_{14}H_{28})_x$
III. Polypentadecenes-$(C_{15}H_{30})_x$
IV. Polyhexadecenes-$(C_{16}H_{32})_x$
V. Polyheptadecenes-$(C_{17}H_{34})_x$
VI. Polyoctadecenes-$(C_{18}H_{36})_x$
VII. Polynonadecenes-$(C_{19}H_{38})_x$; and
VIII. Polyeicosenes-$(C_{20}H_{40})_x$.

Examples of specific semicrystalline polyolefin polymers illustrated in this copending application include poly-1-pentene; poly-1-tetradecene; poly-1-pentadecene; poly-1-hexadecene; poly-1-heptadecene; poly-1-octadecene; poly-1-nonadecene; poly-1-eicosene; mixtures thereof; and the like. These materials are particularly suitable for making matte or low gloss black copies and prints.

In U.S. Pat. No. 5,278,016 the disclosure of which is totally incorporated herein by reference, there are illustrated toner compositions comprised of pigment particles and resin polymer particles, and wherein the toner is subjected to halogenation resulting in the formation of a toner shell. The aforementioned toner resin particles are preferably comprised of ultra low melt resin polymers, which in embodiments possess a glass transition temperature of from about 20° to about 75° C., and preferably from about 33° to about 60° C. as determined by DSC (differential scanning calorimetry), and wherein the toner melts at from about 220° to about 300° F. and preferably 250° F. The halogenated, especially chlorinated, encapsulating polymer surfaces can possess glass transition temperature values between about 55° and 110° C., and preferably from about 100° to about 110° C. The high glass transition temperature surfaces, or shell impart, for example, robustness to the toners. The toner core comprised of resin and pigment has, for example, a glass transition temperature of from about 20° to about 110° C., preferably from about 25° to about 60°, and more preferably about 40° C., thus the toner is considered a low, or ultra low melting composition. The advantages of the hydrogenated resins over the halogenated toners of U.S. Pat. No. 5,278,016 are better control of the Tg of the shell coating that encapsulates the soft core. Partial catalytic hydrogenated ultra low melt polymers are disclosed on page 20 of the aforementioned copending application. Other advantages include improved release of toned images from the fuser roll, improved oxidative, light and chemical stability of toner compositions, chemical resistance to charge control agents for improved tribo stability, and improved lubricity of the toner compositions for better release from fuser rolls without sacrificing image fix.

SUMMARY OF THE INVENTION

It is an object of the present invention to provide toner and developer compositions which possess many of the advantages illustrated herein.

In another object of the present invention there are provided developer compositions with positively or negatively charged toners containing therein a low melt resin, or resins.

Also, in another object of the present invention there are provided toner compositions containing hydrogenated polymers as resinous components, which when formulated into toner particles can possess a glass transition temperature of from about 20° to about 75° C., and preferably from about 33° to about 60° C., and shell glass transition temperatures greater than 50° C., which do not block or cake together at temperatures of, for example, near 120° F.

Further, in an additional object of the present invention there are provided developer compositions comprised of toner particles having incorporated therein hydrogenated resins, and carrier particles.

Additionally, in another object of the present invention there are provided improved toner compositions and wherein release components such as silicone oils can be avoided, or the amount used minimized when the toners are selected for the development of electrostatic images.

Also, in another object of the present invention there are provided developers with stable triboelectric charging characteristics for extended time periods exceeding, for example, 500,000 imaging cycles.

Another object of the present invention resides in the provision of toner compositions with excellent blocking temperatures, and acceptable fusing temperature latitudes, and wherein wax components can be added to the toner surface, and remain thereon.

Furthermore, in an additional object of the present invention there are provided developer compositions containing carrier particles with a coating thereover comprised of a mixture of polymers that are not in close proximity in the triboelectric series, reference U.S. Pat. Nos. 4,937,166, and 4,935,326, the disclosures of which are totally incorporated herein by reference.

Also, in yet a further object of the present invention there are provided developer compositions with carrier particles comprised of a coating with a mixture of polymers that are not in close proximity, that is for example a mixture of polymers from different positions in the triboelectric series, and wherein the toner compositions incorporated therein possess excellent admix charging values of, for example, less than one minute, and triboelectric charges thereon of from about positive or negative 10 to about 40 microcoulombs per gram.

Another object of the present invention is to provide oxidatively stable saturated toner polymers prepared by the hydrogenation of styrenes, such as styrene butadiene copolymers, polybutadienes, and the like, and wherein the resulting resins can be formulated into toners selected for release agent management of xerographic imaging and printing systems wherein the amount of release components, such as silicone oil is reduced, or no silicone oil is needed.

In another object of the present invention, there can be provided hydrogenated toner compositions and developer compositions wherein the toner contains additive components, such as UNILINS®, reference U.S. Pat. No. 4,883,736, the disclosure of which is totally incorporated herein by reference, microcrystalline waxes, semicrystalline components, and the like to enable, for example, the effective molten toner release from fuser rolls, and for improved fusing latitudes with low amounts of release fluids, such as silicone oils. Moreover, these waxy materials can be formed by the hydrogenation of butadiene containing polymers and oligomers.

In another object of this invention, block copolymers can be used as compatibilizing agents for release agent management involving the release of molten toner images from the fuser roll at reduced silicone oil contents.

In another object, a hydrogenated block copolymer with Tg near 80° C. can be selected for the preparation of a liquid developer ink with, for example, ISOPAR L™, which ink can be selected for the development of images.

These and other objects can be accomplished in embodiments of the present invention by providing hydrogenated toner and developer compositions. More specifically, in embodiments of the present invention there are provided toner compositions comprised of pigment particles and hydrogenated resin polymer particles. The aforementioned toner resin particles are preferably comprised of ultra low melt resin polymers, which in embodiments of the present invention possess a glass transition temperature of from about 20° to about 75° C., and preferably from about 33° to about 60° C. as determined by DSC (differential scanning calorimetry), and wherein the toner melts at from about 220° to about 300° F.

In embodiments of the present invention, hydrogenation of the toner resin can be accomplished in the bulk or on the surfaces of toner particles to form hydrogenated toner particle shells encapsulating unsaturated toner particle cores.

Hydrogenation can be accomplished by the homogeneous Wilkinson's or Crabtree catalysts or heterogeneous palladium on carbon catalyst with hydrogen gas at elevated temperature of about 100° C. and pressures of about 1,000 psi, or by using diimide. Diimide is generated in situ using tosylhydrazine (at least 2 equivalents per olefin), hydrazine and oxygen (air) with trace amounts of copper salts, or 4 acid equivalents and at least 2 olefin equivalents of potassium azodicarboxylate (itself generated from azodicarbonamide). Diimide is an effective reducing reagent for the hydrogenation of olefinic double bonds at atmospheric pressure in polar and apolar solvents. The advantage to diimide is that this reagent is expected to be effective for the hydrogenation of toner surfaces in alcohol or water to form hydrogenated polymer shells on unsaturated polymer surfaces. For hydrogenation of bulk toner resins using the homogeneous Wilkinson's catalyst, the resin (50 grams), triphenyl phosphine (7 grams), and catalyst (chlorotristriphenylphosphinerhodium, 0.9 gram) were dissolved in toluene (250 milliliters) in a Parr pressure reactor, and then after several nitrogen purges, hydrogen was gradually charged to 1,000 psi with slow controlled heating. The reaction mixture was maintained at 100° C. with constant stirring for 3 days. The hydrogenated polymer was then precipitated into methanol, isolated by filtration, and then vacuum dried. When palladium on carbon (5 grams) was used as catalyst, the same procedure was followed except no triphenylphosphine was used and the polymer was filtered to remove catalyst prior to precipitation into methanol. Under the conditions used, only olefinic bonds originating from the butadiene segments reacted with the hydrogen. Hydrogenation of all or nearly all butadiene moieties in the polymers took place when the Wilkinson catalyst was used. However, incomplete hydrogenation of butadiene moieties (between 60 and 80 percent) may be encountered when palladium on carbon was used to catalyze the hydrogenation of random styrene butadiene copolymers. The amount of hydrogenation in the product was determined by quantitative determination of olefinic double bonds using $^{13}C$ and $^{1}H$ NMR spectrometry, and FTIR spectroscopy.

The toners of the present invention in embodiments are comprised of the hydrogenated resin particles and pigment particles, which have usually been prepared in an extrusion or melt mixing apparatus, followed by attrition and classification to provide toners with an average diameter of from about 7 to about 25 microns, and preferably about 10 microns. The toner compositions of the present invention in embodiments possess a melting temperature of from about 220° to about 300°, and preferably about 250° F., as determined in a Xerox Corporation 1075 imaging apparatus fuser operating at a speed of about 11 inches per second, or a Xerox Corporation 5028 imaging apparatus fuser operating at a speed of about 3.3 inches per second. The toners of the present invention in embodiments have excellent nonblocking characteristics, that is, they do not cake or agglomerate; caking and agglomeration are usually considered unacceptable at temperatures of from, for example, about 100° F. to about 110° F. The blocking temperatures can be determined by a number of methods; for example, the blocking temperatures of the toners can be determined by placing a sample of the toner, for example from about 5 to about 10 grams, in an aluminum pan of about 2 inches in diameter and about 0.5 inch in height, and heated at 100° F. for 24 hours, followed by repeating the heating at 110°, 115°, 120°, and 125° F. for 24 hours at each temperature. Should the toner become caked, agglomerated, or slightly agglomerated as determined by visual observation and by touch, it fails the aforementioned blocking test. Toners that pass the blocking test are free flowing thereby permitting images of high quality to be continuously obtained in an imaging apparatus, especially xerographic imaging and printing devices operating at high speed of greater than about 75 copies per minute wherein the temperature thereof can attain a value of as high as about 115° F. Shell formation can be indicated, for example, by the aforementioned blocking test, the reactants selected, and by fusing test methods.

DESCRIPTION OF EMBODIMENTS OF THE PRESENT INVENTION

Examples of resins that can be subjected to hydrogenation can, for example, be represented by the following formulas wherein the substituents are as indicated herein, that is for example m, n and o represent the number of segments, such as from 1 to about 200:

I. poly(styrene$_m$-butadiene$_n$);
II. poly(styrene$_m$-isoprene$_n$);
III. poly(styrene$_m$-butadiene$_n$-butene$_o$);
IV. poly(styrene$_m$-isoprene$_n$-isopentene$_o$);
V. poly(styrene$_m$-butadiene$_n$)-$CO_2H$;
VI. $HO_2C$-[poly(styrene$_m$-butadiene$_n$)]-$CO_2H$;
VII. poly(styrene$_m$-butadiene$_n$-dihalobutene$_o$); and
VIII. poly(styrene$_m$-isoprene$_n$-dihaloisopentene$_o$).

Examples of resins include random styrene-butadiene copolymers prepared by anionic and free radical polymerizations in bulk, solution, suspension and emulsion. The stereochemistry of the butadiene olefin can be 1,2-vinyl, 1,4-cis or 1,4-trans. These resins contain unsaturated carbon to carbon double bonds which can be hydrogenated to form saturated resins.

When the resins are hydrogenated, it is believed that the olefinic bonds react by addition of hydrogen and the bonds become saturated. Although in theory it is possible to hydrogenate all unsaturated double bonds, in practice only the double bonds derived from butadiene and not those derived from styrene become hydrogenated under the conditions used. More vigorous hydrogenation catalysts, such as Raney nickel, can be used to hydrogenate styrenic double bonds.

In embodiments, the phrase "ultra low melt" resins is intended to illustrate the physical and thermomechanical properties of the material, that is, these resins exhibit glass transition temperatures (Tg) that are typically less than about 50° C., but may be from about 20° C. to about 75° C.

A suitable source of resins can be derived from anionic polymerization of styrene and butadiene which allows for the preparation of random, block or multiblock copolymers with precise control of molecular weight, stereochemistry of the diene component, and monomer content and sequence. This high degree of architectural control is made possible since, for example, anionic polymerization conditions generate "living" polymers wherein the styrene and butadiene may be interchanged during the polymerization process by the operator. Hence, unique A-B type multiblock polymer compositions may be prepared as illustrated in U.S. Pat. No. 5,158,851, the disclosure of which is incorporated herein by reference in its entirety. Moreover, suspension, emulsion and bulk styrene-butadiene copolymers can be used. The styrene-butadiene suspension copolymers are easy to prepare, of low cost, and do not require rigorously purified reagents and solvents, unlike anionic polymerization processes.

Generally, the polymers of the present invention in embodiments thereof can be prepared by well established procedures, for example suspension styrene-butadiene polymers of U.S. Pat. No. 4,560,635, the disclosure of which is totally incorporated herein by reference; the aforementioned anionic styrene-butadiene polymer processes, U.S. Pat. No. 5,158,851; and commercially available SPAR TM resins available from Resana Inc. of Brazil, and which resins are then subjected to hydrogenation as illustrated herein.

In another embodiment, the aforementioned toner particles are hydrogenated, partially or exhaustively, for example 100 percent, to convert olefinic double bonds by an addition reaction to the surface polymer chain backbone and pendant groups converting olefins into the corresponding hydrogenated, saturated hydrocarbon functionality. In many instances, surface hydrogenation of toner particles affords further control of the variety of rheological properties that may be obtained from polymer resins. Surface hydrogenation is accomplished with a gaseous mixture or liquid solution of an effective amount of from 0.01 to about 5 double bond molar equivalents of hydrogen gas in suitable polymeric solvents.

The aforementioned hydrogenated toner resin polymers are generally present in the toner composition in various effective amounts depending, for example, on the amount of the other components, and the like. Generally, from about 70 to about 95 percent by weight of the hydrogenated polymers is present, and preferably from about 80 to about 90 percent by weight is present. Alternatively, surface hydrogenation forms shells which may be present in the toner composition between 1 and 30 weight percent of the toner composition.

Numerous well known suitable pigments or dyes can be selected as the colorant for the toner particles including, for example, carbon blacks available from Cabot Corporation such as REGAL 330®, BLACK PEARLS L TM, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 2 percent by weight to about 20 percent, and preferably from about 2 to about 10 weight percent based on the total weight of the toner composition, however, lesser or greater amounts of pigment particles may be selected in some embodiments of the present invention.

Various magnetites, which are comprised of a mixture of iron oxides ($FeO.Fe_2O_3$) in most situations, including those commercially available such as MAPICO BLACK TM, can be selected for incorporation into the toner compositions illustrated herein. The aforementioned pigment particles are present in various effective amounts; generally, however, they are present in the toner composition in an amount of from about 10 percent by weight to about 30 percent by weight, and preferably in an amount of from about 16 percent by weight to about 19 percent by weight. Other magnetites not specifically disclosed herein may be selected.

A number of different charge enhancing additives may be selected for incorporation into the bulk toner, or onto the surface of the toner compositions to enable these compositions to acquire a positive or negative charge thereon of from, for example, about 10 to about 35 microcoulombs per gram as determined by the known Faraday Cage method for example. Examples of charge enhancing additives include alkyl pyridinium halides, including cetyl pyridinium chloride, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and other similar known charge enhancing additives, such as distearyl dimethyl ammonium bisulfate, reference U.S. Pat. Nos. 4,937,157 and 4,904,762, negative charge additives like aluminum and chromium complexes, such as TRH, and the like, as well as mixtures thereof in some embodiments. These additives are usually present in an amount of from about 0.1 percent by weight to about 15 percent by weight, and preferably these additives are present in an amount of from about 0.2 percent by weight to about 5 percent by weight. A number of different known charge enhancing additives may be selected for incorporation into the bulk toner, or onto the surface of the toner compositions of the present invention to enable these compositions to acquire a negative charge thereon of from, for example, about −10 to about −35 microcoulombs per gram. Examples of known negative charge enhancing additives include alkali metal aryl borate salts, for example potassium tetraphenyl borate, reference U.S. Pat. No. 4,767,688 and U.S. Pat. No. 4,898,802, the disclosures of which are totally incorporated herein by reference; the aluminum salicylate compound BONTRON E-88® and zinc complexes, such as BONTRON E-44® available from Orient Chemical Company; the metal azo complex TRH available from Hodogaya Chemical Company; and the like.

Additionally, because hydrogenated polymers are situated intermediate in the triboelectric series of resins, both negative and positive toners can be prepared without added charge control agents provided the carrier is selected appropriately.

Moreover, the toner composition can contain as internal or external components other additives, such as colloidal silicas inclusive of AEROSIL®, metal salts, such as titanium oxides, tin oxides, tin chlorides, and the like; metal salts of fatty acids such as zinc stearate, reference U.S. Pat. Nos. 3,590,000 and 3,900,588, the disclosures of which are totally incorporated herein by reference; and waxy components, particularly those with a molecular weight of from about 1,000 to about 15,000, and preferably from about 1,000 to about 6,000, such as polyethylene and polypropylene, which additives are generally present in an amount of from about 0.1 to about 5 percent by weight.

Characteristics associated with the toner compositions of the present invention in embodiments thereof include a fusing temperature of less than about 225° to about 250° F., and a fusing temperature latitude of from about 250° to about 350° F. Moreover, it is observed that the aforementioned toners possess stable positive or negative triboelectric charging values of from about 10 to about 40 microcoulombs per gram and the triboelectric charging values are stable for an extended number of imaging cycles exceeding, for example, in some embodiments one million developed copies in a xerographic imaging apparatus, such as for example the Xerox Corporation 1075. Although it is not desired to be limited by theory, it is believed that two important factors for the slow, or substantially no degradation in the triboelectric charging values reside in the unique physical properties of the hydrogenated toner particles selected, and moreover the stability of the carrier particles utilized. Also of importance in embodiments of the present invention is the consumption of less energy with the toner compositions since they can be fused at a lower temperature, that is about 230° F. (fuser roll set temperature) compared with other conventional toners including those containing certain styrene butadiene resins which fuse at from about 300° to about 330° F. In addition, the hydrogenated toner particles possess in some embodiments the other important characteristics mentioned herein inclusive of a toner core glass transition temperature of from about 24 to about 74 and preferably from about 24° to about 60° C.

As carrier particles for enabling the formulation of developer compositions when admixed in a Lodige blender, for example, with the toner, there are selected various known components including those wherein the carrier core is comprised of steel, nickel, magnetites, ferrites, copper zinc ferrites, iron, polymers, mixtures thereof, and the like which cores may contain known polymeric coatings such as polymethylmethacrylates, methyl terpolymers, KYNAR®, TEFLON®, and the like. Also useful are the carrier particles as illustrated in U.S. Pat. Nos. 4,937,166 and 4,935,326, the disclosures of which are totally incorporated herein by reference.

These carrier particles can be prepared by mixing low density porous magnetic, or magnetically attractable metal core carrier particles with from, for example, between about 0.05 percent and about 3 percent by weight, based on the weight of the coated carrier particles of a mixture of polymers until adherence thereof to the carrier core by mechnical impaction or electrostatic attraction; heating the mixture of mechanical impaction or electrostatic attraction; heating the mixture of carrier core particles and polymers to a temperature, for example, of between from about 200° F. to about 550° F. for a period of from about 10 minutes to about 60 minutes enabling the polymers to melt and fuse to the carrier core particles; cooling the coated carrier particles; and thereafter classifying the obtained carrier particles to a desired particle size.

In a specific embodiment of the present invention, there are provided carrier particles comprised of a core with a coating thereover comprised of a mixture of a first dry polymer component and a second dry polymer component. The aforementioned carrier compositions can be comprised of known core materials including iron with a dry polymer coating mixture thereover. Subsequently, developer compositions of the present invention can be generated by admixing the aforementioned carrier particles with the toner compositions comprised of the hydrogenated resin particles, pigment particles, and other additives.

Thus, a number of suitable solid core carrier materials can be selected. Characteristic carrier properties of importance include those that will enable the toner particles to acquire a positive or negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics. Preferred carrier cores include ferrites and sponge iron, or steel grit with an average particle size diameter of from between about 30 microns to about 200 microns.

Illustrative examples of polymer coatings selected for the carrier particles include those that are not in close proximity in the triboelectric series. Specific examples of polymer mixtures selected are polyvinylidenefluoride with polyethylene; polymethylmethacrylate and copolyethylenevinylacetate; copolyvinylidene fluoride tetrafluoroethylene and polyethylene; polymethylmethacrylate and copolyethylene vinylacetate; and polymethylmethacrylate and polyvinylidene fluoride. Other coatings, such as polyvinylidene fluorides, fluorocarbon polymers including those available as FP-461, terpolymers of styrene, methacrylate, and triethoxy silane, polymethacrylates, reference U.S. Pat. Nos. 3,467,634 and 3,526,533, the disclosures of which are totally incorporated herein by reference, and not specifically mentioned herein, can be selected providing the objectives of the present invention are achieved.

With further reference to the polymer coating mixture, by close proximity as used herein it is meant that the choice of the polymers selected are dictated by their position in the triboelectric series, therefore, for example, one may select a first polymer with a significantly lower triboelectric charging value than the second polymer. Other known carrier coatings may be selected such as fluoropolymers like KYNAR 301F TM styrene terpolymers, trifluorochloroethylene/vinylacetate copolymers, polymethacrylates, and the like, at carrier coating weights of, for example, from about 0.1 to about 5 weight percent.

The carrier coating for the polymer mixture can be present in an effective amount of from about 0.1 to about 3 weight percent, for example. The percentage of each polymer present in the carrier coating mixture can vary depending on the specific components selected, the coating weight, and the properties desired. Generally, the coated polymer mixtures used contain from about 10 to about 90 percent of the first polymer, and from about 90 to about 10 percent by weight of the second polymer. Preferably, there are selected mixtures of polymers with from about 30 to about 60 percent by weight of the first polymer, and from about 70 to about 40 percent by weight of a second polymer. In one embodiment of the present invention, when a high triboelectric charging value is desired, that is exceeding 30 microcoulombs per gram, there is selected from about 50 percent by weight of the first polymer, such as a polyvinylidene fluoride commercially available as KYNAR 301F TM and 50 percent by weight of a second polymer, such as polymethylacrylate or polymethylmethacrylate. In contrast, when a lower triboelectric charging value is required, less than, for example, about 10 microcoulombs per gram, there is selected from about 30 percent by weight of the first polymer, and about 70 percent by weight of the second polymer.

Generally, from about 1 part to about 5 parts by weight of the surface hydrogenated toner particles are mixed with 100 parts by weight of the carrier particles illustrated herein enabling the formation of developer compositions.

Also encompassed within the scope of the present invention are colored toner compositions comprised of hydrogenated toner resin particles, and as pigments or colorants, red, blue, green, brown, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as Cl 60720; Cl Dispersed Red 15, a diazo dye identified in the Color Index as Cl 26050; Cl Solvent Red 19; and the like. Examples of cyan materials that may be used as pigments include copper tetra-4-(octadecyl sulfonamido) phthalocyanine; X-copper phthalocyanine pigment listed in the Color Index as Cl 74160; Cl Pigment Blue; and Anthrathrene Blue, identified in the Color Index as Cl 69810; Special Blue X-2137; and the like; while illustrative examples of yellow pigments that may be selected are diarylide yellow 3,3-dichlorobenzidene acetoacetanilides, a monoazo pigment identified in the Color Index as Cl 12700; Cl Solvent Yellow 16, a nitrophenyl amine sulfonamide identified in the Color Index as Foron Yellow SE/GLN; Cl Dispersed Yellow 33, a 2,5-dimethoxy-4-sulfonanilide phenylazo-4'-chloro-2,5-dimethoxy acetoacetanilide; Permanent Yellow FGL; and the like. These pigments are generally present in the toner composition prior to surface hydrogenation in an amount of from about 1 weight percent to about 15 weight percent based on the weight of the unhydrogenated toner resin particles.

The toner and developer compositions of the present invention may be selected for use in electrophotographic imaging processes containing therein conventional photoreceptors, including inorganic and organic photoreceptor imaging members. Examples of imaging members are selenium, selenium alloys, such as selenium tellurium, selenium arsenic, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules, there can be selected the aryl amines disclosed in the '990 patent. Also, there can be selected as photogenerating pigments, squaraine compounds, azo pigments, perylenes, thiapyrillium materials, and the like. These layered members are conventionally charged negatively, thus usually a positively charged toner is selected for development. Moreover, the developer compositions of the present invention are particularly useful in electrophotographic imaging processes and apparatuses wherein there is selected a moving transporting means and a moving charging means; and wherein there is selected a flexible, including a deflected, layered imaging member, reference U.S. Pat. Nos. 4,394,429 and 4,368,970, the disclosures of which are totally incorporated herein by reference. Images obtained with the developer compositions of the present invention in embodiment theory possess acceptable solids, excellent halftones and desirable line resolution with acceptable or substantially no background deposits. The toner compositions of the present invention may also be used for single component electrophotographic imaging processes and direct electrostatic printing processes.

The following Examples are being supplied to further define the present invention, it being noted that these examples are intended to illustrate and not limit the scope of the present invention. Parts and percentages are by weight unless otherwise indicated. Examples of liquid inks are also included.

The examples include the hydrogenation of free radical polymerized, random, suspension styrene-1,4-butadiene copolymers, anionic polymerized random styrene-high-1,2-butadiene copolymers, anionic polystyrene-block-polybutadiene copolymers, and anionic multiblock styrene-butadiene copolymers, and the use of these materials in toner compositions. Moreover, the treatment of toner surfaces with diimide is described to form hydrogenated toner particles encapsulating low Tg unsaturated copolymer cores. A summary of the various polymer structures, compositions, physical properties, and toner fusing performance are summarized in Tables 1 and 2. Preferred materials have glass transition temperatures between 0° and 75° C., and the toner blocking temperature is approximately related to resin Tg. Higher Tg hydrogenated materials such as those with Tg values near 80° C. may be useful for liquid development inks in which ISOPAR L™ (Exxon) acts as a plasticizer to lower the melting temperature of the developer composition. The $T_1/T_2$ values in Tables 1 and 2 refer to the rheological profiles of the resins as measured with a Rheometrics cone and plate rheometer. $T_1$ is the temperature of the resin where its melt viscosity achieves $7.5\times10^5$ poise at 10 radians per second. $T_2$ is the temperature of the resin where its melt viscosity achieves $4.5\times10^3$ poise at 10 radians per second. These temperatures usually reflect the useful fusing temperatures of the resins as xerographic toners. The minimum fix temperature of the toners is directly related to Tg. Fusing latitude is directly related to polymer weight average molecular weight in the case of the unsaturated copolymers, but is enhanced by between 15° and 20° C. after hydrogenation of the toner composition. The preparation of diblock and multiblock compatibilizers for wax release agents and the hydrogenation of polybutadiene release agent material like those typically added to toner compositions in blends are described in the following Examples.

In general, the hydrogenation of random styrene-butadiene copolymers changes the Tg of the parent resin by only ±5° C., irrespective of whether the butadiene is incorporated in the copolymer in the 1,2- or the 1,4-regio-stereoisomer. The hydrogenation of block and multi-block styrene-butadiene copolymers results in products with a markedly increased Tg compared with that of the original unhydrogenated copolymer. The Tg increase is often greater than 20° C., and there is a corresponding increase in the blocking temperature of the toner composition. The polybutadiene block segment is apparently acting as a superior plasticizer or solubilizing agent for the polystyrene block component compared with its hydrogenated analog. Hydrogenation of polybutadiene segments results in the formation of polyethylene or polybutene repeat units in the copolymer chains. Some of these materials may be useful in liquid development ink systems as well as dry xerographic processes.

EXAMPLE I

Preparation of Low Melt Poly(styrene-butadiene) Toner Resin by Suspension Polymerization Tricalcium phosphate (2.5 grams) was suspended in a solution of ALKANOL™ a sodium sulfonate salt of naphthalate available from E. I. DuPont (48 milligrams) in deionized water (40 milliliters). The mixture was added to a modified Parr pressure reactor containing 60 milliliters of deionized water. The reactor was sealed and the contents were stirred at approximately 500 rpm while being heated to 95° C. over a period of 40 minutes. The reactor was flushed with nitrogen gas. After 40 minutes, a solution of styrene (46.8 grams), 1,3-butadiene (13.2 grams), benzoyl peroxide (3.0 grams) and TAEC (0,0-t-amyl-0-(2-ethyl hexyl)monoperoxy carbonate available from Pennwalt or Lubrizol) (0.20 milliliter) was added to the reactor via a sparge tube, under positive pressure of nitrogen gas, over a period of 4 minutes. The final reactor pressure was typically from between 90 and 100 psi. The reaction proceeded at 95° C. for 192 minutes. Fifteen minutes before the end of the 95° C. ramp, the reactor was vented 5 times over a period of 10 minutes to liberate unreacted 1,3-butadiene. The reaction mixture was heated to 125° C. over 40 minutes, maintained at 125° C. for 60 minutes, then cooled. The product was stirred with nitric acid (6 milliliters) for 10 minutes, filtered, washed twice with 300 milliliters of deionized water and dried under vacuum 16 hours at 40° C. The yield was typically greater than 97 percent. The copolymer had a glass transition of 38° C., an $M_n$ of 11,000 and an $M_w$ of 108,000.

The above Example I reaction was scaled up to a 10 gallon reactor and the product was a poly(styrene, 22-weight-percent butadiene) copolymer with a glass transistion of 36.9° C., an $M_n$ of 15,000 and an $M_w$ of 120,000. Similar reactions were carried out to prepare suspension styrene-butadiene copolymers with at 13, 18 and 22 weight percent butadiene contents. These materials were then hydrogenated, and the products were characterized, fabricated into xerographic toners as indicated herein and then evaluated. The results are summarized in Table 1.

Preparation of Hydrogenated Suspension Styrene Butadiene Copolymers for Toner Resins A 13 weight percent butadiene styrene copolymer (50 grams), which was prepared by following the suspension polymerization procedure described above, was hydrogenated in toluene (250 milliliters) under 1,000 psi hydrogen using tris(triphenyl)phosphine rhodium chloride (0.9 gram) and triphenylphosphine (7 grams) at 100° C. for 3 days. The polymer was precipitated into methanol, filtered and then vacuum dried. The Tg of the resultant polymer was 60.3° C. compared with 58.1° C. of the starting polymer. The FTIR-, the $^1$H- and $^{13}$C-NMR spectra were consistent with complete hydrogenation and disappearance of butadienyl double bonds. The olefinic bonds attributed to styrene aromatic groups were unchanged by this treatment. Thus, the butadienyl groups in the product were completely hydrogenated as evidenced by FTIR spectroscopy and NMR spectrometry.

Toner was prepared by extrusion, ZSK extruder, with 6 weight percent of REGAL 330® carbon black, 92 percent by weight of the above prepared copolymer, and 2 weight percent of cetyl pyridinium chloride at 130° C. followed by micronization. The minimum fix of the resultant toner was 300° C. compared with 295° C. for the unhydrogenated starting polymer. The hot offset temperature of the hydrogenated toner was 342° F. compared with the 335° C. for the unhydrogenated toner composition. The fusing test was carried out using a Zerox 5028 silicone fuser operated at 3.3 inches per second without silicone release agent. A suspension, 18 weight percent of butadiene styrene copolymer, was prepared and hydrogenated, and a toner was prepared as described above. The Tg of the product was 50.9° C. compared with 45.4° C. of the starting polymer. Improved toner blocking resistance consistent with the increased Tg was observed with the hydrogenated polymer. Improved release from the fuser roll was evident by the increased hot offset temperature measured for the hydrogenated product compared with the unhydrogenated control toner. Other suspension copolymers were hydrogenated as described above, and the results are summarized and compared in Table 1.

EXAMPLE II

Preparation and Evaluation of Low Melt Toner Particles

Low melt toner particles were prepared by extruding in a ZSK extruder the low melt hydrogenated and unhydrogenated poly(styrene-18-eight percent-butadiene) resins (94 percent and 95 percent, respectively) of Example I with 6 weight percent of REGAL 330® carbon black with and without 2 percent of cetyl pyridinium chloride (CPC). When the CPC is present, the resin amount is reduced accordingly. The extrudates were micronized to provide toner particles with an average diameter of 10 microns. The minimum fix temperature of the toner with hydrogenated copolymer was 260° F. and 270° F., determined with a Xerox Corporation 5028 silicon fuser roll operating at 3.1 inches per second. Hot offset temperature of the unhydrogenated toner was 310° F., compared with 320° F. for the hydrogenated toner. Roll temperature was determined using an Omega pyrometer and was checked with wax paper indicators. Both toner materials failed blocking tests by fusing together near their respective resin glass transition temperatures of 45° C. and 50.9° C. The triboelectric values against a carrier comprised of steel coated with polyvinylidene fluoride, 0.75 percent, after 0.5 hour on a roll mill were 20 microcoulombs per gram at 3 percent toner concentration for the hydrogenated toner and 30 microcoulombs per gram at 3 percent toner concentration for the unhydrogenated toner as measured with a standard known Faraday Cage apparatus.

The minimum fix temperature or the lowest fuser set temperature at which acceptable toner adhesion to paper took place was determined by a crease test, tape test, erasure (Pink Pearl) resistance and 75 degrees gloss at 10 gloss units. The crease test was accomplished as follows: a solid area image at 0.9 to 1.1 grams of toner per gram of paper (g/g) was folded 180 degrees with the image side inward. When unfolded, the crease area was observed as 60 visually and compared to Xerox Corporation 1075 imaging apparatus fix standards.

The tape test was accomplished by placing SCOTCH® brand Magic 810 (¾ inch) tape on the solid area of the fused toner image and the tape was then removed. The amount of toner retained by the tape (without paper fibers) was minimal as determined by visual observation. Hot offset temperature was determined when fused toner images offset, or transfer from paper onto the fuser roll, and then reprint onto the same paper or onto other subsequent sheets of paper. Two known indications that offset results include printing on the fuser roll and ghost image areas on the final copy paper after transfer.

EXAMPLE III

Preparation of a Random Anionic Low Melt Styrene Butadiene Resin $S_{141}Bd_{109}$ and Toner (24691-79)

All transfers were conducted under dry high purity argon. Cyclohexane was distilled over sodium hydride argon. Liquid butadiene measured by weight and volume was stored over sodium hydride in a septum capped beverage bottle at −15° C. Transfers were made with cannula inserted directly into a weighed graduated cylinder containing cold cyclohexane under argon. Styrene was distilled under argon over sodium hydride. Rubber septa were used as stoppers. Tetrahydrofuran was distilled from blue sodium-benzophenone ketyl under argon. Lithium and naphthalene were used as received from Aldrich Chemical Company. Cooling of the reaction was carried out by means of a dry ice isopropanol bath.

A 12 liter flask equipped with a mechanical stirrer, two rubber septa, and an argon needle inlet was purged with argon. Cyclohexane (200 milliliters) and 1.3 molar sec-butyllithium were added and vigorously stirred to splash the sides of the flask. The sec-butyllithium-cyclohexane solution was then removed from the flask by cannula. The flask was then rinsed with more cyclohexane (200 milliliters) which was also removed by cannula under argon. Freshly distilled cyclohexane (1,500 milliliters), diisopropenylbenzene (27.21 grams) and 1.3 molar sec-butyllithium (264 milliliters) were then added to the empty flask and the reaction mixture was heated at 50° C. for 4 hours under argon. The red reaction mixture was cooled between 0° and −20° C. using a dry ice-isopropanol bath, and tetrahydrofuran (232 milliliters) and cyclohexane (1,500 milliliters) were added. The reactor was cooled to −35° C. and then a solution of cyclohexane (1,350 milliliters), styrene (1,350 milliliters), and butadiene (690 milliliters) was added in 5 equal portions at 1 hour intervals with 5 minutes required for each addition. Each of the 5 additions added over 5 minutes consisted of cyclohexane (279 milliliters), styrene (270 milliliters) and butadiene (230 milliliters). Complete addition of monomers had taken place in about 4 hours while the reaction was maintained between 0° and −20° C. The reaction mixture was allowed to warm to 25° C. over 2 hours, and stirring was then continued for 16 hours at 25° C. Isopropyl alcohol (20 milliliters) was added to terminate the living anions and the reaction solution was added to 10 gallons of isopropanol to precipitate the crude product polymer. The polymer collected by filtration was dissolved in methylene chloride at 20 weight percent solids and was then added to isopropanol (10 gallons) to reprecipitate the polymer. The polymer was collected by filtration and washed with methanol (5 gallons). The polymer in methylene chloride at 20 weight percent was added to 10 gallons of methanol to precipitate a white polymer which was collected by filtration and then vacuum dried at 25° C. The weight and number average molecular weights were 32,300 and 20,470, respectively, as determined by size exclusion chromatography. The $^1$H NMR spectrum was consistent with a styrene butadiene block copolymer with 28.58 weight percent (43.54 mol percent) of butadiene of which 86.1 percent were 1,2-vinyl groups. The glass transition temperature was 43.9° C. as determined by differential scanning colorimetry. The polymer yield was about 92 percent.

A toner was prepared by extrusion of the above polymer, 92 percent, 6 percent of REGAL 330® carbon black and 2 percent of CPC (cetyl pyridinium chloride charge additive) followed by micronization to 10 microns. The minimum fix temperature of the toner was 230° F. as determined by no cracking of the fused toner images as a result of a 180 degrees paper crease test (paper folded 180 degrees, visually observed the breadth of cracking at crease) and the minimum fix temperature of the toner was 230° F. when no appreciable, for example a peppered, toned image was removed with SCOTCH® Tape Magic 810, and the hot offset temperature was 320° F. where the toned image sticks to silicone roll fuser as indicated herein. When fused, toner images were observed to offset from paper onto a silicone fuser roll, and then was imprinted onto the same paper or subsequent papers. The hot offset temperature, where the toner failed to release from the fuser roll, was 300° F.

The triboelectric values against a carrier of steel coated with KYNAR® for the untreated (unhydrogenated) toner was 30 microcoulombs per gram (3.15 percent toner concentration), and 20 for the toner with the hydrogenated resin.

The minimum fix temperature is the lowest fuser set temperature at which acceptable toner adhesion to paper was accomplished as determined by the crease test, tape test erasure resistance, gloss 10 at 75 degrees (angle), and Taber abraser. The crease test was accomplished by repeating the process of Example III. The tape test is carried out by adhering SCOTCH® brand Magic 810 (¾ inch tape) on the solid area and the tape is then removed. The amount of toner retained by the tape (without paper fibers) is quantified according to standards. A peppered toner image on the tape is the minimum fix temperature.

Preparation of a Hydrogenated Random Anionic Low Melt Styrene Butadiene Resin and Toner (25414-3)

A 28.6 weight percent butadiene styrene copolymer (50 grams), prepared by following polymerization procedure as described above, in toluene (250 milliliters) was hydrogenated under 1,000 psi of hydrogen using tris(triphenyl)phosphine rhodium chloride (0.9 gram) and triphenylphosphine (7 grams) at 100° C. for 3 days. The polymer was precipitated into methanol, filtered and then vacuum dried. The Tg of the resultant polymer was 40.5° C. compared with 43.9° C. measured for the starting polymer. The FTIR-, the $^1$H- and $^{13}$C-NMR spectra were consistent with complete hydrogenation and elimination of olefin double bonds. The olefinic bonds attributed to styrene aromatic groups were unchanged by this treatment. Thus, the butadienyl groups in the product were completely hydrogenated as evidenced by FTIR spectroscopy and NMR spectrometry. The useful FTIR absorbances are as follows: C=C (1,638 cm$^{-1}$), 1,2-vinyl (994 cm$^{-1}$ and 908 cm$^{-1}$), and trans 1,4-butadienyl groups (967 cm$^{-1}$). The $^1$H NMR spectrum of hydrogenated resin is best consistent with the disappearance of the butadienyl olefinic protons between 4.3 and 6 ppm. Toner was made by extrusion with 6 weight percent of REGAL 300® carbon black and 2 weight percent of cetyl pyridinium chloride at 130° C. followed by micronization in the usual way. The minimum fix of the resultant toner was 300° C. compared with 295° C. for the unhydrogenated starting polymer. The hot offset temperature of the hydrogenated toner was 380° F. compared with the 350° F. for the unhydrogenated toner composition. The fusing test was carried out using a Xerox 5028 silicone fuser operated at 3.3 inches per second without silicone release agent. Improved release from the fuser roll was evident by the increased hot offset temperature measured for the hydrogenated product compared with the control toner. Other suspension copolymers were hydrogenated as described above, and the results are summarized and compared in Table 2.

Images were then developed using the aforementioned prepared developer compositions of the present invention with a positive charge control additive in a xerographic imaging test fixture with a negatively charged layered imaging member comprised of a supporting substrate of aluminum, a photogenerating layer of trigonal selenium, and a charge transport layer of the aryl amine N,N'-diphenyl-N,N'-bis(3-methylphenyl)1,1'-biphenyl-4,4'-diamine, 45 weight percent, dispersed in 55 weight percent of the polycarbonate MAKROLON® reference U.S. Pat. No. 4,265,990, the disclosure of which is totally incorporated herein by reference. Alternatively, images were developed by cascading developer (toner and carrier) over paper situated between two parallel metal plates (a capacitor) charged to approximately 1,000 volts D.C. until constant weight toner mass areas were obtained. Images of excellent resolution with substantially no background deposits resulted.

EXAMPLE IV

Preparation of Polystyrene-polybutadiene MultiBlock Polymer Initiated with n-Butyllithium (23780-61)

The following materials were added to a clean, dry 1 liter beverage bottle: cyclohexane (120 milliliters); 10 milliliters of 1.6 molar n-butyllithium; 24.1 grams (25 milliliters) of styrene, 13.2 grams of butadiene in 70 milliliters of cyclohexane after 3 hours; 23.6 grams (25 milliliters) after 6 hours; 13.69 grams of butadiene in 70 milliliters cyclohexane after 9 hours; 24.3 grams (25 milliliters) of styrene after 6 hours; 15.2 grams of butadiene in 70 milliliters of cyclohexane after 3 hours, 23.4 grams (25 milliliters) of styrene after 6 hours, 13.6 grams of butadiene in 70 milliliters of cyclohexane after 9 hours, 24.3 grams (25 milliliters) of styrene after 6 hours; 13.2 grams of butadiene in 70 milliliters of cyclohexane after 3 hours, and then 23.4 grams (25 milliliters) of styrene after 6 hours. After 16 hours stirring, methanol (1 milliliter) was added and the reaction mixture turned colorless. The reaction mixture was added to methanol (1 gallon) to precipitate the polymer using a Waring blender. After isolation by filtration, the polymer was dried in vacuo to yield 209 grams of white powder (99 percent yield). A broad glass transition temperature between 40° and 52° C. was determined using DSC (differential scanning calorimetry). The butadiene content was 30 weight percent as determined by $^1H$ NMR spectrometry. The percent of cis, trans, and vinyl butadiene regio-stereo-isomers was 16, 19 and 65, respectively. The GPC weight and number average molecular weights were 37,400 and 23,100. The minimum fix temperature of the copolymer as toner processed with 6 percent of REGAL 330®92 percent of the above resin, and 2 percent of the charge additive TP-302 TM was between 220° and 240° F. The toner hot offset temperature was 300° F. determined with a Xerox Corporation 5028 silicone soft roll fuser.

Preparation of Hydrogenated Polystyrene-polybutadiene Multiblock Polymer (23780-74)

The multiblock copolymer prepared as described above (30 grams) in toluene (200 milliliters) was combined with triphenylphosphine (6 grams) and tris(triphenylphosphine)rhodium chloride (1 gram) in toluene (50 milliliters) in a 500 milliliter Parr pressure reaction vessel. The mixture was purged with hydrogen, sealed, charged to 200 psi with hydrogen, and then heated with stirring to 100° C. The hydrogen pressure was increased to 800 psi. The hydrogen pressure was maintained above 600 psi for 24 hours at 100° C. with stirring. The reaction mixture was added to methanol. The precipitate was washed with water, acidic methanol, and then methanol. The precipitate was collected by filtration, and vacuum dried to yield 30 grams of brown powder. The copolymer was reprecipitated from methylene chloride (10 weight percent solids) into methanol (1 gallon) and then vacuum dried. The polymer was about 78 percent hydrogenated; 95 percent of the 1,2-vinyl groups and 54 percent of the 1,4-conformers were hydrogenated. The glass transition temperature measured using DSC was broad and centered near 54° C. The polymer was formulated into toner by melt extrusion, 92 weight percent, with 6 percent of REGAL 330® and 2 percent of TP-302 TM (Nachem) followed by micronization. The minimum fix temperature of the toner was 230° F. and the hot offset temperature was between 280° and 300° F.

EXAMPLE V

Preparation of Hydrogenated Polystyrene-Polybutadiene Diblock Polymer $S_{23}Bd_{19}$(23780-77-20)

A beverage bottle equipped with a stir bar and a rubber septum was purged with argon. Cyclohexane (75 milliliters), styrene (25 milliliters) and 10 milliliters of 1.6 molar n-butyllithium in hexanes were added via syringe. Three hours later, butadiene (20 milliliters) in cyclohexane (50 milliliters) was added. After 16 hours of continued stirring, the reaction mixture was added to methanol to precipitate the polymer. The yield of polymer after vacuum drying was 60.4 grams. The GPC weight and number average molecular weight was 28,600 and 6,040 with a trimodal distribution. A broad glass transition temperature centered between 51° and 53° C. was measured using DSC. The mol percent of styrene and butadiene was 56 and 44 as determined using $^1H$ and $^{13}C$ NMR spectrometry. The percentage of cis, trans, and vinyl butadiene ratios was 28, 43 and 28, respectively. The structural formula approximates $S_{23}Bd_{19}$. The polymer was converted into toner by melt extrusion with 6 percent of REGAL 330® and 2 percent of cetyl pyridium chloride, followed by micronization. The minimum fix temperature was 228° F. and the hot offset temperature was 250° F. as determined using a Xerox Corporation 5028 soft silicone roll fuser operated at 3.3 inches per second. The product was hydrogenated in toluene using tristriphenylphosphine rhodium chloride at 100° C. at 1,000 psi hydrogen for 3 days. After precipitation into methanol followed by vacuum drying, the product had a broad Tg centered near 75° C.

EXAMPLE VI

Hydrogenation of Polybutadiene-diol

Polybutadiene-diol (50 grams) and palladium on carbon (3.5 grams) in cyclohexane (400 milliliters) were twice purged with 30 psi nitrogen and then charged with 200 psi hydrogen. The pressure dropped immediately and an exotherm took place. More hydrogen was added and the reactor was maintained at 550 psi hydrogen for 23 hours. After heating 4 hours at 50° C. and a total of 950 psi hydrogen was consumed, the completely hydrogenated polymer was filtered and then isolated and purified by reprecipitation into isopropanol (1 gallon) and then into methanol from methylene chloride (10 weight percent solids). The polymer was vacuum dried to yield a white waxy solid. This polymer was added at 4 weight percent to toner compositions, such as those of Example IV, wherein the resin of this Example, 92 weight percent, was selected resulting in improved release of molten toner from the fuser roll.

EXAMPLE VII

Proposed Hydrogenation of Toner Particle Surfaces

A styrene butadiene multiblock copolymer 24590-21 with the structure $(S_{18}Bd_{15})_5S_{18}$ was formulated into toner by extrusion thereof, 94 weight percent, with 6 weight percent of REGAL 330®, followed by micronization. The toner (10 grams) was suspended in water (50 milliliters) and ethanol (50 milliliters) while diimide was generated in situ. The toner was isolated by filtration and washed with water and then ethanol. The toner was then vacuum dried. The surface of the toner particles was believed to be hydrogenated on the basis of improved blocking test results and fusing performance. The diimide used in this reaction was generated in the following way. Azodicarbonamide (Aldrich, 10 grams) was mixed with potassium hydroxide (25 grams) in water (25 grams) in a 1 liter beaker with ice bath cooling. Stirring was carried out by means of a metal spatula. Vigorous ammonia evolution was observed. Fine yellow needles formed as a thick paste which were separated onto filter paper using a Buchner filter funnel. The precipitate was added to water at 0° C. and then cold alcohol was added to form a yellow powder which was isolated by filtration and then vacuum dried. The yellow powder (10 grams) was added to the toner suspension in water (50 milliliters) and ethanol (50 milliliters), and then 15 grams of acetic acid were added dropwise with magnetic stirring. The suspension was allowed to stand for 16 hours before the toner was isolated by filtration, washed with water and then alcohol. The toner was then vacuum dried. The toner with hydrogenated shell had improved toner fusing and blocking characteristics. The hydrogenated shell polymer is expected by inference to have a broad Tg centered between 50° and 60° C. The above toner had a minimum fix temperature at 235° F. and a hot offset temperature near 330° F. The diimide treated toner passed the blocking test at 110° F. The untreated toner did not pass the blocking test at 110° F., in that it agglomerated at 110° F.

EXAMPLE VII

A beverage bottle equipped with a stir bar and rubber septum was purged with argon. Cyclohexane (100 milliliters), styrene (30 milliliters) and 10 milliliters of 1.6 molar n-butyllithium in hexanes were added. Five hours later, butadiene (20 milliliters) in cyclohexane (30 milliliters) were added. After 16 hours, the reaction mixture was poured over dry ice in a glove bag under argon. The colorless product was washed with diluted hydrochloric acid, water, and then methanol using a Waring blender. The polymer was collected by filtration and dried under vacuum. The yield (36.0 grams) was 84 percent. The polymer had a glass transition temperature at 65.8° C., and was formulated into toner by melt extrusion thereof, 92 weight percent, with 6 weight percent of REGAL 330 ® carbon black and 2 weight percent of TP-302 TM charge control agent, followed by micronization. The minimum fix temperature of the toner was 250° F. and the hot offset temperature was 330° F. as determined with a Xerox Corporation 5028 fuser roll operated at 3.3 inches per second.

Hydrogenation of Carboxy-Tipped Polystyrene-Polybutadiene Diblock Polymer $S_{38}BD_{14}COOH$ (23780-92-30)

Hydrogenation of polymer 23780-92 (20 grams) was accomplished in a Parr pressure reaction vessel (500 milliliters) as described above in 250 milliliters of toluene with triphenylphosphine (5 grams) and tristriphenylphosphinerhodium chloride (0.8 gram). The hydrogen pressure of 1,000 psi was maintained for 24 hours at 100° C. with stirring. The reaction mixture was then added to methanol using a Waring blender, and the precipitated polymer was collected by filtration and dried in vacuo. The yield was 19.7 grams. The glass transition temperature was 84.6° C. as determined by DSC.

Preparation of Cyan Liquid Ink in ISOPAR L TM

The hydrogenated $S_{38}BD_{14}COOH$ (23780-92-30, 19.7 grams) prepared as described above was added to a Union Process 01 shot mill attritor with 2,385 grams of 11/64$^{th}$ inch stainless steel shot. PV FAST BLUE TM (5.05 grams), aluminum stearate (Witco 22, 0.5 gram) and ISOPAR L TM (134 grams) were added. With stirring, the mixture was heated with steam to 200° F. After 5 minutes, steam heating was discontinued, and stirring was continued for 2 hours without external heating. The mixture was then stirred for 4 hours with cold water cooling near 19° C. The particle dimensions were approximately 2 microns as determined by means of an optical microscope. The mixture was separated from the steel shot using more ISOPAR L TM and a filter screen. The liquid ink was approximately 6.5 weight percent solids. The ink was then used to make draw bar gravure coatings on VITON ® coated aluminum foil. The coating was then heated for 5 minutes at 100° C. to remove the ISOPAR L TM. The ink coating on VITON ® was heated to 90° C. and then was transferred to Xerox 4024 paper using a 500 psi cold nip roll laminating transfix system. The resultant image demonstrated excellent fix to the paper. This ink when diluted to 2 weight percent with ISOPAR L TM and treated with 1.5 weight percent of BASIC BARIUM PETRONATE ® or lecithin was suited for image development in a Savin 870 liquid ink photocopy machine.

Other modifications of the present invention may occur to those skilled in the art subsequent to a review of the present application, and these modifications are intended to be included within the scope of the present invention.

TABLE 1

Physical Properties and Fusing Behavior of Styrene Butadiene Copolymers and Hydrogenated Styrene Butadiene Copolymers

| SAMPLE | SUSPENSION POLYMERS | $T_g$ °C. | Wt. % Bd | % 1, 2-Vinyl | GPC $M_w$ | GPC $M_n$ | MFT °F. | HOT °F. | $T_1/T_2$, °C. | MFT Reduction °C./Fusing Latitude °C. |
|---|---|---|---|---|---|---|---|---|---|---|
| 24691-1 | Suspension Styrene-13 wt % BD | 58.1 | 13.0 | 0 | 134,000 | 19,200 | 295 | 335 | 107/154 | −8/22 |
| 25183-104 | Suspension Styrene-Hydrogenated-13 wt % BD | 60.3 | | | 134,000 | 19,200 | 302 | 342 | | −4/22 |
| 24590-4 | Suspension Styrene-18 wt % BD | 45.4 | 18.0 | 0 | 209,900 | 17,690 | 257 | 310 | 85/145 | −29/29 |
| 24590-4-15 | Suspension Styrene-Hydrogenated-18 wt % BD | 50.9 | | | 209,900 | 17,690 | 270 | 320 | 91/150 | −22/29 |
| PP1988-SHB-1 | Suspension Styrene-22 wt % BD | 35.7 | 22.0 | 0 | 124,700 | 12,900 | 225 | 270 | 77/124 | −47/25 |

TABLE 1-continued

Physical Properties and Fusing Behavior of Styrene Butadiene Copolymers and Hydrogenated Styrene Butadiene Copolymers

| SAMPLE | SUSPENSION POLYMERS | $T_g$ °C. | Wt. % Bd | % 1, 2-Vinyl | GPC $M_w$ | GPC $M_n$ | MFT °F. | HOT °F. | $T_1/T_2$, °C. | MFT Reduction °C./Fusing Latitude °C. |
|---|---|---|---|---|---|---|---|---|---|---|
| 29814-98 | Suspension Styrene-Hydrogenated-22% BD | 36.9 | | | 124,700 | 12,900 | 230 | 275 | 78/124 | −44/25 |

TABLE 2

Physical Properties and Fusing Behavior of Anionic Styrene-Butadiene Copolymers and Hydrogenated Styrene-Butadiene Copolymers

| SAMPLE | ANIONIC POLYMERS | $T_g$ °C. | Wt. % Bd | % 1, 2-Vinyl | GPC $M_w$ | GPC $M_n$ | MFT °F. | HOT °F. | $T_1/T_2$ | Fusing Latitude °C./MFT Reduction °C. |
|---|---|---|---|---|---|---|---|---|---|---|
| 23780-77-20 | $S_{23}BD_{19}$ | 51.0 | 29.0 | 28 | 28,600 | 6,000 | 228 | 250 | | −46/12 |
| 23780-92 | $S_{23}BD_{19}COOH$ | 65.8 | 29.0 | 28 | 28,600 | 6,040 | 250 | 331 | 97/117 | −33/45 |
| 23780-92-30 | Hydrogenated 23780-92 | 84.6 | | | 28,600 | 6,040 | | | | |
| 24590-1 | $S_{23}BD_{60}COOH$ | <25 | 69.8 | 22 | 19,450 | 7,700 | | | | |
| 24590-1-34 | Hydrogenated 24590-1 | 86.6 | | | 19,450 | 7,700 | 210 | | | |
| 23780-49-3 | $S_{45}BD_{10}$ | 52.0 | 10.3 | 22 | 14,400 | 7,700 | 240 | 270 | 103/118 | −39/17 |
| 23780-49-5 | $S_{35}BD_{14}$ | 43.5 | 16.1 | 23 | 14,600 | 6,700 | 245 | 270 | | −36/14 |
| 23780-49-4 | $S_{53}BD_{19}$ | 49.5 | 15.7 | 19 | 16,800 | 9,100 | 255 | 285 | | −17/31 |
| 23780-49-8 | $S_{67}BD_{30}$ | 64.5 | 18.9 | 21 | 24,300 | 12,800 | 260–275 | 290 | 107/126 | −25/14 |
| 23780-77-35 | $S_{14.5}BD_{22}S_{14.5}$ | 52.0 | 28.3 | 45 | 19,400 | 5,840 | 210 | 237 | 80/95 | −55/15 |
| 23780-90-32 | Hydrogenated 23780-77-35 | 88.5 | | | 19,400 | 5,840 | 220 | 260 | 103/123 | −50/22 |
| 23780-77-25 | $S_{16}BD_{14}S_{16}$ | 26.0 | 18.5 | 39 | 17,000 | 4,810 | 210 | 251 | 75/98 | −55/23 |
| 23780-77-10 | $(S_{17}BD_{19}S)_2S_{17}$ | 40.0 | 28.3 | 41 | 20,800 | 10,000 | 210 | 275 | 75/97 | −55/36 |
| 23780-90 | Hydrogenated 23780-77-10 | 67.0 | | | 20,800 | 10,000 | 220 | 260 | 99/121 | −50/22 |
| 23780-97 | $S_{30}BD_{15}S_{30}$ | 51.0 | 12.2 | 21 | 24,400 | 8,720 | 250 | 290 | 97/121 | −33/22 |
| 23780-95-1 | $(S_{30}BD_{15})_2S_{30}$ | 43.0 | 14.8 | 30 | 18,100 | 11,000 | 250 | 305 | 90/121 | −33/30 |
| 24590-9-11 | Hydrogenated 23780-95-1 | 71.0 | | | 18,100 | 11,000 | 290 | | 97/121 | −11/— |
| 23780-96 | $(S_{15}BD_{15})_2S_{15}$ | 44.0 | 25.7 | 40 | 15,500 | 8,300 | 210 | 250 | 78/101 | −55/22 |
| 23780-99 | 60%-Hydrogenated 23780-96 | 54–75.6 | | | 16,000 | 9,200 | 220 | | | −50/— |
| 23780-98 | $(S_{15}BD_{15})_3S_{15}$ | Broad | 20.6 | 45 | 21,300 | 12,500 | 210 | 245 | 76/97 | −55/19 |
| 23780-98-30 | Hydrogenated 23780-98 | 47.0 | | | 21,300 | 12,500 | 245 | 280 | | −36/19 |
| 23780-86 | $(S_{30}BD_{15})_3S_{30}$ | Broad | 24.5 | 40 | 27,300 | 16,500 | 240 | 290 | 85/113 | −39/27 |
| 24590-27-8 | Hydrogenated 23780-86 | 60.8 | | | 27,300 | 16,500 | 270 | 300 | | −22/17 |
| 23780-61 | $(S_{15}BD_{15})_5S_{15}$ | 48.0 | 30.0 | 65.0 | 37,400 | 23,100 | 230 | 284 | 79/109 | −44/30 |
| 23780-74 | Hydrogenated 23780-61 | 52.0 | 6.6 | 3.25 | 38,630 | 18,000 | 240 | 300 | 84/115 | −39/33 |
| 23780-87 | $(S_{15}BD_{10})_5S_{15}$ | Broad | 22.4 | 22.0 | 29,300 | 17,700 | 230 | 280 | 83/110 | −44/27 |
| 24590-6 | Hydrogenated 23780-87 | 55.2 | | | 30,900 | 20,300 | 245 | 280 | | −36/19 |
| 23780-89 | $(S_{22}BD_{15})_5S_{22}$ | 57.9 | 22.8 | 25.0 | 38,200 | 24,300 | 250 | 306 | 88/119 | −33/31 |
| 24590-27-3 | Hydrogenated 23780-89 | 71.7 | | | 33,200 | 20,100 | | | | |
| 23780-88 | $S_{30}BD_{15}(S_{15}BD_{15})_4S_{30}$ | Broad | 24.5 | | 51,700 | 33,100 | 265 | 324 | 91/124 | −25/33 |
| 23780-72 | $(S_{30}BD_{15})_5S_{30}$ | 33.0 | 17.8 | 65.0 | 36,400 | 23,000 | 270 | 340 | 93/132 | −22/39 |
| 23780-75 | Hydrogenated 23780-72 | Broad | | | 36,400 | 23,000 | 310 | | | 0/— |
| 23780-104 | $(S_{12}BD_{15})_5S_{12}$ | Broad | 35.0 | 65.0 | 23,200 | 14,300 | 240 | | | −39/— |
| 24590-9-12 | Hydrogenated 23780-104 | Broad 73.0 | | | 23,200 | 14,300 | | | | |
| 23780-102 | $(S_{15}BD_{15})_5S_{15}$ | 48.0 | 30.0 | 65.0 | 25,600 | 18,100 | 240 | 290 | | −39/28 |
| 24590-8-8 | Hydrogenated 23780-102 | 52.0 | | | 25,600 | 18,100 | 260 | 300 | | −28/22 |
| 23780-95-1 | $(S_{30}BD_{30})_5S_{30}$ | Broad | 30.0 | 65.0 | 44,300 | 26,800 | 260 | 300 | | −28/22 |
| 24590-9-11 | Hydrogenated 23780-95-1 | 54.0 | | | 44,300 | 26,800 | 290 | 340 | | −11/28 |
| 23780-103 | $(S_{15}BD_{15})_5S_{15}$ | Broad | 30.0 | 65.0 | 29,500 | 19,700 | 230 | 270 | | −44/22 |
| 24590-3 | Hydrogenated 23780-103 | Broad | | | 29,500 | 19,700 | | | | −28/22 |
| 24590-20 | $(S_{18}BD_{15})_5S_{18}$ | 40.2 | 26.5 | 65.0 | 32,600 | 21,800 | 235 | 300 | 96/127 | −42/36 |
| 24590-26A | Hydrogenated 24590-20 | 51.0 | | | 32,600 | 21,800 | 240 | 310 | 98/125 | −39/39 |
| 24590-21 | $(S_{18}BD_{15})_5S_{18}$ | 41.6 | 26.5 | 65.0 | 38,470 | 26,100 | 235 | 300 | 96/127 | −42/36 |
| 24590-26B | Hydrogenated 24590-21 | 50.0–63.7 | | | 35,700 | 22,600 | 240 | 310 | 98/125 | −38/38 |
| 24691-79 | Random $S_{141}Bd_{109}$ | 43.9 | 28.6 | 86.1 | 32,300 | 20,500 | 230 | 300 | 78/102 | −44/39 |
| 25414-3 | Hydrogenated 24691-79 | 40.5 | | | 32,300 | 20,500 | 225 | 295 | | −47/39 |

What is claimed is:

1. A toner composition consisting essentially of pigment particles and low melt hydrogenated resin particles of the formula $(A\text{-}B)_n$ wherein A represents a polymer segment of a first monomer, B represents a polymer segment of a second monomer, and n is at least 1 and represents the number of A and B segments; and wherein said hydrogenated resin particles contain said pigment particles dispersed therein.

2. A toner composition in accordance with claim 1 wherein n is a number of from about 2 to about 100.

3. A toner composition in accordance with claim 1 wherein from about 1 to about 100 A segments are present.

4. A toner composition in accordance with claim 1 wherein from about 1 to about 100 B segments are present.

5. A toner composition in accordance with claim 1 wherein the A segments are comprised of a polystyrene.

6. A toner composition in accordance with claim 1 wherein the B segments are comprised of a polybutadiene.

7. A toner composition in accordance with claim 1 wherein said low melt polymer is poly(styrene-1,2-butadiene).

8. A toner composition in accordance with claim 1 wherein said low melt polymer is poly(styrene-1,4-butadiene).

9. A toner composition in accordance with claim 1 wherein the resin is of a number average molecular weight of from about 3,000 to about 100,000.

10. A toner composition in accordance with claim 1 wherein the resin dispersity ratio $M_w/M_n$ is from about 1 to about 15.

11. A toner composition in accordance with claim 1 wherein the pigment particles are selected from the group consisting of carbon black, magnetites, and mixtures thereof.

12. A toner composition in accordance with claim 1 wherein the pigment particles are selected from the group consisting of red, blue, green, brown, cyan, magenta, yellow, and mixtures thereof.

13. A toner composition in accordance with claim 1 containing charge enhancing additives.

14. A toner composition in accordance with claim 13 wherein the charge enhancing additives are selected from the group consisting of alkyl pyridinium halides, organic sulfates, organic bisulfates, organic sulfonates, distearyl dimethyl ammonium methyl sulfate, distearyl dimethyl ammonium bisulfate, cetyl pyridinium lakes, polyvinyl pyridine, treated carbon blacks, tetraphenyl borate salts, phosphonium salts, nigrosine, metal-salicylate salts, metal complexes, polystryene-polyethylene oxide block copolymer salt complexes, poly(dimethyl amino methyl methacrylate), metal azo dye complexes, organo-aluminum salts, and zinc stearate.

15. A toner composition in accordance with claim 13 wherein the charge enhancing additive is present in an amount of from about 0.1 to about 10 percent by weight.

16. A toner composition in accordance with claim 14 wherein the triboelectric charge on the toner is from about a positive or negative 5 to about a positive or negative 35 microcoulombs per gram.

17. A toner composition in accordance with claim 1 with a fusing temperature of between about 200° F. to about 370° F.

18. A developer composition comprised of the toner composition of claim 1 and carrier particles.

19. A developer composition in accordance with claim 18 wherein the carrier particles are selected from the group consisting of a core of steel, iron, and ferrites.

20. A developer composition in accordance with claim 18 wherein the carrier particles include thereover a polymeric coating.

21. A method for developing images which comprises the formation of an electrostatic latent image on a photoconductive member; developing the resulting image with the toner composition of claim 1; subsequently transferring the developed image to a suitable substrate; and thereafter permanently affixing the image thereto, while the toner composition maintains its electrical characteristics for one million copies.

22. A toner composition in accordance with claim 1 wherein said resin particles possess a glass transition temperature of about 20° C. to about 75° C.

* * * * *